United States Patent [19]

Milad

[11] Patent Number: 4,732,106

[45] Date of Patent: Mar. 22, 1988

[54] STEERING CONTROL FOR SUBMARINES AND THE LIKE

[76] Inventor: Anis I. Milad, 2938 Yorkway, Baltimore, Md. 21222

[21] Appl. No.: 887,921

[22] Filed: Jul. 22, 1986

[51] Int. Cl.[4] ..... B63G 8/16; B63H 5/12

[52] U.S. Cl. ..... 114/338; 74/89.15; 74/665 B; 219/121 LU; 239/265.35; 239/587; 244/51; 244/52; 440/58; 440/63; 901/25

[58] Field of Search ..... 114/337, 338; 440/58–60, 63; 244/51, 52, 66, 76 J, 169, 74; 239/265.35, 587; 74/665 B, 665 A, 89.15; 901/25; 219/121 LU, 121 LV, 121 LW, 121 LX

[56] References Cited

U.S. PATENT DOCUMENTS

| | | | |
|---|---|---|---|
| 1,409,850 | 3/1922 | Haney | 244/51 X |
| 2,131,155 | 9/1938 | Waller | 244/51 |
| 3,809,318 | 5/1974 | Yamamoto | 239/587 X |
| 4,281,795 | 8/1981 | Schweikl | 239/265.35 |
| 4,497,319 | 2/1985 | Sebine et al. | 219/121 LU |
| 4,501,522 | 2/1985 | Causer et al. | 901/25 X |
| 4,542,278 | 9/1985 | Taylor | 219/121 LV |
| 4,578,554 | 3/1986 | Coulter | 219/121 LV |
| 4,579,299 | 4/1986 | Lavery et al. | 239/265.35 X |

*Primary Examiner*—Sherman D. Basinger
*Attorney, Agent, or Firm*—Leonard Bloom

[57] ABSTRACT

A steering apparatus for steering propulsion devices such as a propeller shaft and rocket exhaust and for aiming devices such a fire hoses and lasers. The steering apparatus provides a rotational component and a tilting component to the orientation of the steered device.

13 Claims, 16 Drawing Figures

STEERING CONTROL FOR SUBMARINES AND THE LIKE

BACKGROUND OF THE INVENTION

The present invention relates to the field of steering mechanisms for orienting apparatus to selectable orientations, and more particularly to steering propeller shafts such as in submarines for submarine steering, to aiming laser beams, and to controlling the direction of flow of propelled fluids such as rocket exhaust or water in a fire hose.

In the art of orienting power flow such as in a propeller shaft or orienting an aimed device such as a laser, or fire hose, the orienting system is generally one based upon motion in linear directions in an orthogonal X-Y reference system.

It would be desirable to provide a steering mechanism which employed rotational motion of the steered or aimed device. Rotational steering motion would add a degree of smoothness and a pattern of curvilinear changing orientation that is not obtainable by employing a linear X-Y steering system.

SUMMARY OF THE INVENTION

Accordingly, it is a primary object of the present invention to provide a steering apparatus for orienting power flow which employs a rotational component in the steering.

Another object of the invention is to provide a steering apparatus which employs both a rotational and a tilt component in the steering of the power flow.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus and method is provided for steering a propeller shaft coupled to a power source. The steering apparatus is comprised of steerable means for changing the direction of the propeller shaft. The direction changing means is capable of being both rotated and tilted. The steering apparatus is further comprised of operator controlled means which steer the propeller shaft direction changing means. The operator controlled means include means for rotating and means for tilting the propeller shaft direction changing means. The propeller shaft is coupled to a drive shaft source of power by a universal joint.

In a further aspect of the invention, in accordance with its objects and purposes, a steering apparatus is provided for steering an article to be aimed such as a laser or fire hose. The article steering apparatus is comprised of means for tilting and rotating the article to thereby orient or aim the article.

In accordance with another aspect of the invention, an apparatus is provided to steer a fluid propellant such as rocket exhaust. Means are provided to steer the exhaust by a propulsion guide that is capable of being both tilted and rotated for steering.

The steering apparatus of the invention is comprised of means for changing direction of the steered article or material, means for both tilting and rotating the direction changing means, means for tilting the means for both tilting and rotating the direction changing means, and means for rotating the means for both tilting and rotating the direction changing means.

Preferably, the means for both tilting and rotating the direction changing means is comprised of first sleeve means and an angled projecting means projecting from the first sleeve means.

In the preferred embodiment, the tilting means is comprised of first varying length strut means connected to the angled projecting means, threaded bar means, first joint means for connecting the threaded bar means to the first varying length strut means, second varying length strut means, second joint means for connecting the threaded bar means to the second varying length strut means, second sleeve means connected to the second telescoping means, internally threaded and externally toothed first tilt gear means mounted on the threaded bar means by threaded engagement, second tilt gear means having an eccentric annular gear and engaging the first tilt gear means for rotating the first gear means along the threaded bar means and for raising and lowering the threaded bar means thereby tilting the direction control means. The tilting means may be further comprised of flexible line means connected to the first sleeve means, rotating line receiving means for receiving the line means, line connecting means for connecting the line means to the angled projecting means.

Preferably, the flexible line means is a chain, and the line receiving means is a toothed gear for engaging the chain.

The tilting means is controlled by a first control shaft and gear means for engaging the second tilt gear means having the eccentric annular gear.

Preferably, the rotating means is comprised of first and second rotation gear means having respective guide means projecting therefrom. In the preferred embodiment, the rotating means is further comprised of second control shaft and respective gear means for engaging the first and second rotation gear means. Second sleeve means are provided for mounting the first rotation gear.

In the preferred embodiment of the invention, the first sleeve means is on the distal side of a universal joint connecting the propeller shaft with the rotating power source, and the second sleeve means is on the proximal side of the universal joint.

Still other objects of the present invention will become readily apparent to those skilled in this art from the following description, wherein there is shown and described a preferred embodiment of this invention simply by way of illustration. The invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE INVENTION

Figure 1:
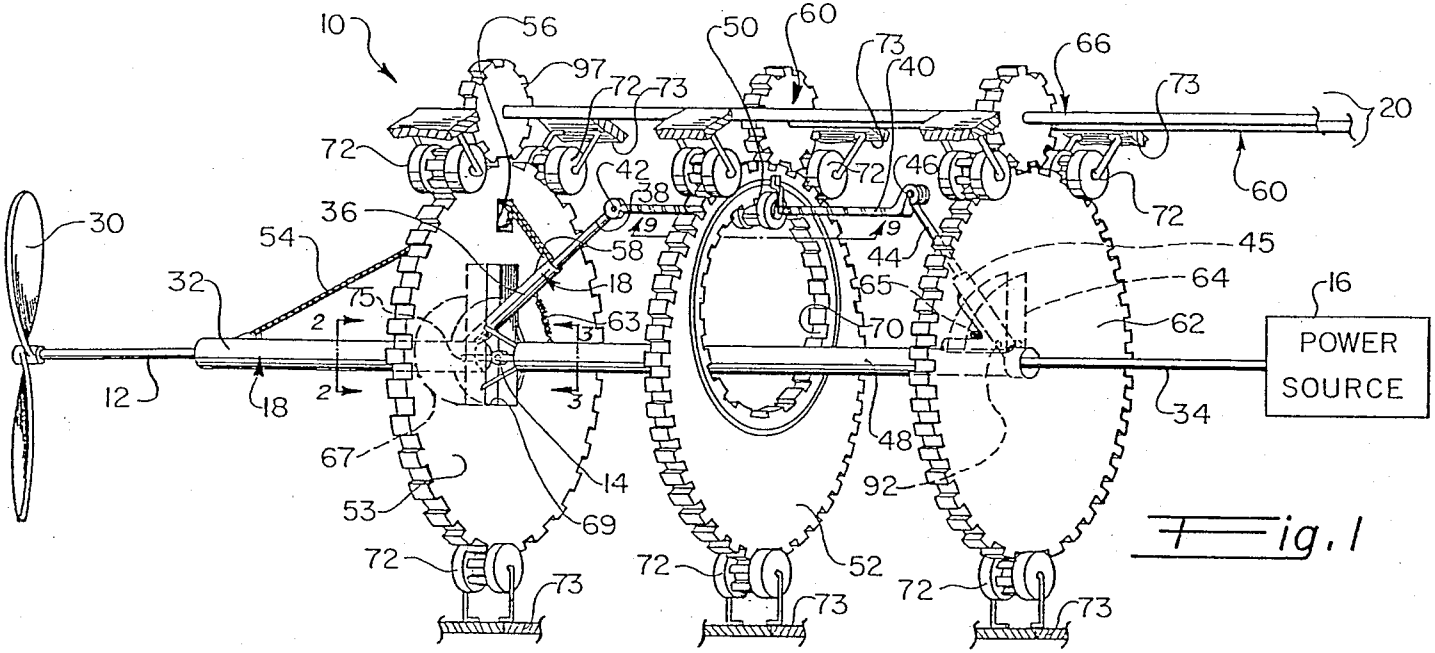
FIG. 1 is an isometric view (somewhat schematic) of the structure of the present invention.

Reference is made to FIG. 1 which shows steering apparatus 10 for a vehicle powered by a propulsion means. The steering apparatus is comprised of steerable propulsion output means 12, such as propeller shaft 12. Coupling means 14 is provided for coupling the steerable propulsion output means 12 to a power source 16, such as rotating drive shaft 34. Direction changing means 18 is provided for steering the steerable propulsion output means 12. The direction changing means 18 is capable of being tilted and rotated. Control means 20 are provided for controlling the direction changing means 18. Steering means are controlled by the control means 20 for steering the direction changing means 18 thereby steering the steerable propulsion output means 12 for steering the vehicle.

The direction changing means 18 is comprised of propulsion guide means 32 for guiding at least a portion of the propulsion output for steering the vehicle. The steering means includes means for tilting the propulsion guide means 32 and means for rotating the propulsion guide means 32.

Figure 2:
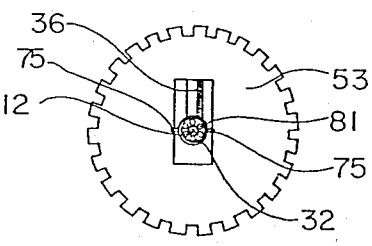
FIG. 2 is a sectional view showing support for first sleeve 32 taken along line 2—2 in FIG. 1.

Preferably, the propulsion guide means 32 includes a first sleeve means 32 jacketing the propeller shaft 12. The propulsion guide means 32 is preferably a first sleeve 32 which is supported by first sleeve support means which are axles 75 (See FIG. 2) connected to the inner opening 69 of second rotation gear means 53. The propeller shaft 12 is supported within the first sleeve 32 by ball bearings. See FIG. 2 for a magnified view of support structures for first sleeve 32. Preferably guides 67 extend from gear 53 to guide sleeve 32 in vertical up and down movement.

The steerable propeller shaft 12 has an attached propeller 30. The propeller shaft 12 is connected to a universal joint 14 which is connected to a drive shaft 34.

Preferably, the means for both tilting and rotating the direction changing means 18 is comprised of first sleeve means 32 and an angled projecting means 36 projecting from the first sleeve means 32.

Figure 3:
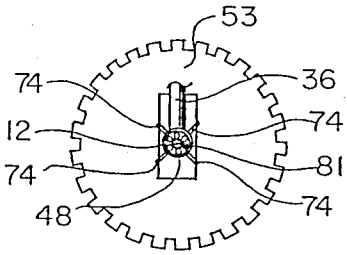
FIG. 3 is a sectional view showing support for second sleeve 48 taken along line 3—3 in FIG. 1.

In the preferred embodiment, the tilting means is comprised of first varying length strut means 38 (which is shown in FIG. 1 to be first telescoping strut means 38) connected to the angled projecting means 36, threaded bar means 40, first joint means 42 for connecting the threaded bar means 40 to the first telescoping strut means 38, second varying length strut means (which is shown in FIG. 1 to be second telescoping strut means 44), second joint means 46 for connecting the threaded bar means 40 to the second telescoping strut means 44, second sleeve means 48 connected to a receiving sleeve 45 which telescopically receives the second telescoping strut means 44 and is pivoted with respect to second sleeve means 48 by pivot means 92, internally threaded and externally toothed first tilt gear means 50 mounted on the threaded bar means 40 by threaded engagement, and eccentric second tilt gear means 52 having an internal annular eccentric gear 70 engaging the first tilt gear means 50 for rotating the first gear means along the threaded bar means 40 and for raising and lowering the threaded bar means 40 thereby tilting the direction control means 18. The second sleeve means 48 is rigidly connected at its proximal end to first rotation gear 62 and is supported at its distal end by second sleeve supporting struts 74 connected to the inner opening 69 of second rotation gear 53. See FIG. 3 for a magnified view of the support structures for second sleeve 48.

Preferably, ball bearings 81 support the drive shaft 34 within second sleeve 48 and support the propeller shaft 12 within first sleeve 32.

The tilting means is further comprised of flexible line means 54 connected to the first sleeve means 32, rotating line receiving means 56 for receiving the line means, and line connecting means 58 for connecting the line means to the angles projecting means. Preferably, the flexible line means 54 is comprised of a chain 54, and the line receiving means 56 is comprised of a toothed gear 56 for engaging the chain.

In the preferred embodiment of the invention, the rotating means is comprised of first rotation gear means 62 having strut guide means 64 projecting therefrom. The strut guide means 64 receives the second telescoping strut means 44.

Preferably, the rotating means is further comprised of second control shaft and gear means 66 for engaging the first rotation gear means 62. The rotating means also is comprised of a third control gear means 97 on the second control shaft and second rotation gear means 53. Second rotation gear means 53 has an interior opening 69 through which angled projection means 36 projects and in which the coupling means 14 is located.

In the preferred embodiment, the first sleeve means 32 is on the distal side of a universal joint 14 connecting the propeller shaft 12 with the rotating power source 16, and the second sleeve means 48 is on the proximal side of the universal joint 14.

In operation of the preferred embodiment, drive shaft 34 is rotated by a power source. Universal joint 14 couples the drive shaft 34 to a propeller shaft 12 having a propeller 30. First sleeve 32 jackets the propeller shaft 12 and is used to change the orientation of the drive shaft. An angled projection 36 is affixed to the first sleeve 32 and is used for steering the sleeve 32. Gears 62, 52, and 53, it is clear from FIG. 1, are parallel with respect to one another.

When an operator turns two steering wheels (not shown), one for tilt control and both together for rotation control, respective control shafts 60 and 66 are rotated for steering. The first control shaft and gear means 60 rotate second tilt gear means 52 which has an eccentric inner annular gear 70. In engagement with the teeth of the inner eccentric gear 70 are the teeth of first tilt gear 50 which is threaded internally for engagement with threaded bar 40. At one end of the threaded bar 40 is a first joint 42 which connects to the threaded bar 40 with first telescoping strut 38 connected to the angled projection 36. At the other end of the threaded bar 40 is a second joint 46 which connects the threaded bar 40 with the second telescoping strut 44.

For tilting the propeller shaft 12, when the first control shaft 60 is rotated for steering, the second tilt gear 52 is also rotated. During rotation of the second tilt gear 52, the teeth of the non-axially located annular gear 70 cause the first tilt gear 50 to rotate. As first tilt gear 50 rotates, the threaded bar 40 advances through the gear 50. Also, as the second tilt gear 52 rotates, the eccentric inner gear 70 causes the first tilt gear to be pushed toward or away from the rotational axis of the drive shaft 34 depending upon the respective direction of rotation. As the bar 40 advances through the first tilt gear 50 in either the distal or proximal direction to bring about either lower or upper tilt respectively from the non-tilt position shown in FIG. 1, the bar 40 is pushed toward the axis of the drive shaft 34, and both the first and second telescoping struts 38 and 44 are adjusted accordingly. As the first tilt gear 50 and the bar 40 are returned to the neutral tilt position shown in FIG. 1, both the first and second telescoping struts 38 and 44 are adjusted accordingly.

Preferably, helical spring 63 is connected between angled projection 36 and sleeve 48. Also, torsion spring 65 is connected between telescoping strut 44 and sleeve 48. Springs 63 and 65 serve to provide biasing force to keep gear 50 in mesh with the teeth of inner gear 70.

As the telescoping struts 38, 44 are adjusted accordingly, as the bar 40 advances proximally through the first tilt gear 50, and as the bar 40 moves toward the axis of the drive shaft 34, the angles projection 36 is pulled down proximally causing propulsion direction changing sleeve 32 to be tilted upward thereby tilting the propeller shaft 12 upward.

As the telescoping struts 38, 44 are adjusted accordingly, as the bar 40 advances distally through the first tilt gear 50, and as the bar 40 moves toward the axis of the drive shaft 34, the angles projection 36 is pushed up distally causing propulsion direction changing sleeve 32 to be tilted downward thereby tilting the propeller shaft 12 downward.

Tilting may be brought about without any rotation of the steering apparatus. However, tilting may be done together with rotation, and thereby generate the family of cones (See FIG. 8).

Similarly, rotation may be brought about without any tilting of the steering apparatus.

For rotating the propeller shaft 12 around the surface of an imaginary cone whose apex is at the coupling means 14, second control shaft and gear means 66 and first control shaft and gear means 60 are turned together to bring about steering.

Both first shaft and gear means 60 and second shaft and gear means 66 including third control gear 97 are operated together so that first rotation gear means 62, second rotation gear means 53, and second tilt gear 52 are rotated at the same time.

First rotation gear 62 has strut guide means 64 projecting therefrom. The strut guide means 64 receives the second telescoping strut means 44 and in conjunction with guide means 95 serve to keep the following structures in alignment and prevent them from twisting: second telescoping strut means 44; threaded bar 40; and angled projection 36.

During rotation the following structures rotate together as one unit without relative motion between them: second telescoping strut means 44; threaded bar 40; first tilt gear 50; direction control means 18; first rotation gear 62; second tilt gear 52; second rotation gear 53; axles 75; sleeve 32; struts 74; and sleeve 48.

Also rotating around the axis of the drive shaft are the chain 54 and the toothed gear 56. Toothed gear 56 is supported by second rotation gear means 53, and second rotation gear 53 also rotates as sleeve 32 rotates. Tooth 56 may have a spiral spring associated with it to bias sleeve 32 toward the neutral position.

Also in FIG. 1, supporting spool gear assemblies 72 are shown supporting gears 62, 52, and 53. The gear assemblies 72 are fixed to the housing 73 which is shown as broken away portions attached to the gear assemblies 72.

Figure 4:
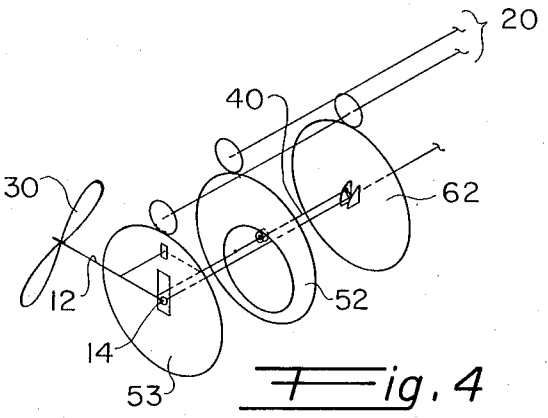
FIGS. 4–7 are schematic illustrations of the articulation and orientation of the propeller shaft under the influence of the present invention.
Figure 5:
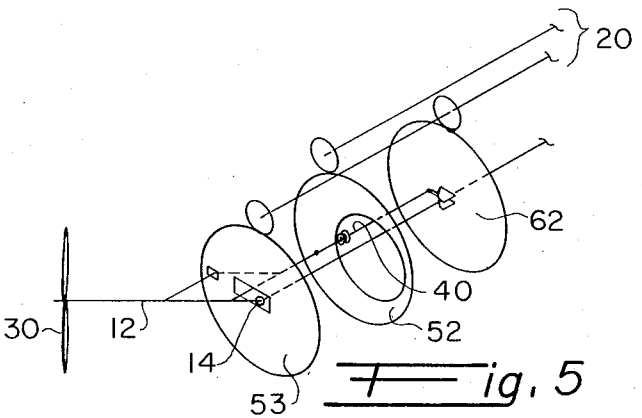
Figure 6:
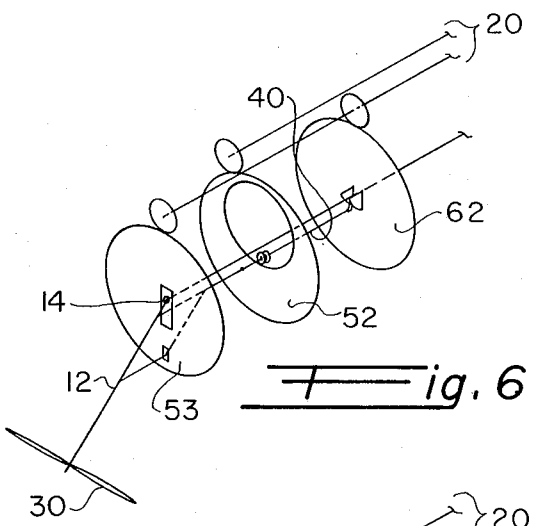
Figure 7:
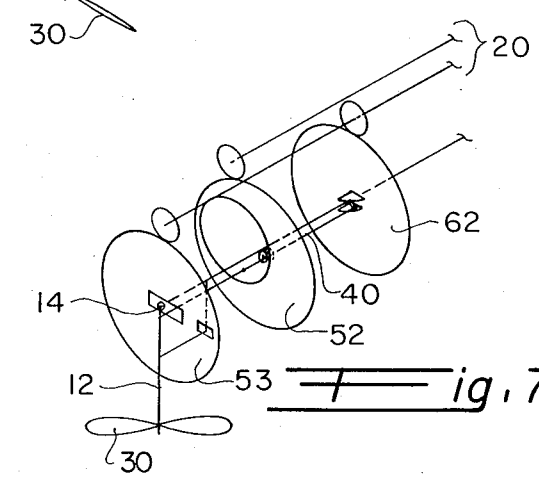

FIGS. 4–7 are illustrations of the tilting and rotation of the propeller shaft 12 as it is steered by the present invention. In FIG. 4, propeller shaft 12 is tilted up. In FIG. 5, propeller shaft 12 has been rotated 90 degrees counterclockwise from the position in FIG. 4. In FIG. 6, propeller shaft 12 has been rotated another 90 degrees counterclockwise from the position shown in FIG. 5. In FIG. 7, propeller shaft 12 has been rotated still another 90 degrees counterclockwise from the position shown in FIG. 6.

FIGS. 4–7 are representative of only four positions of the propeller shaft 12. In actual use, the propeller shaft 12 can be oriented in a continuous family of cones about the axis of the drive shaft 34 to any position within the largest cone.

Figure 8:
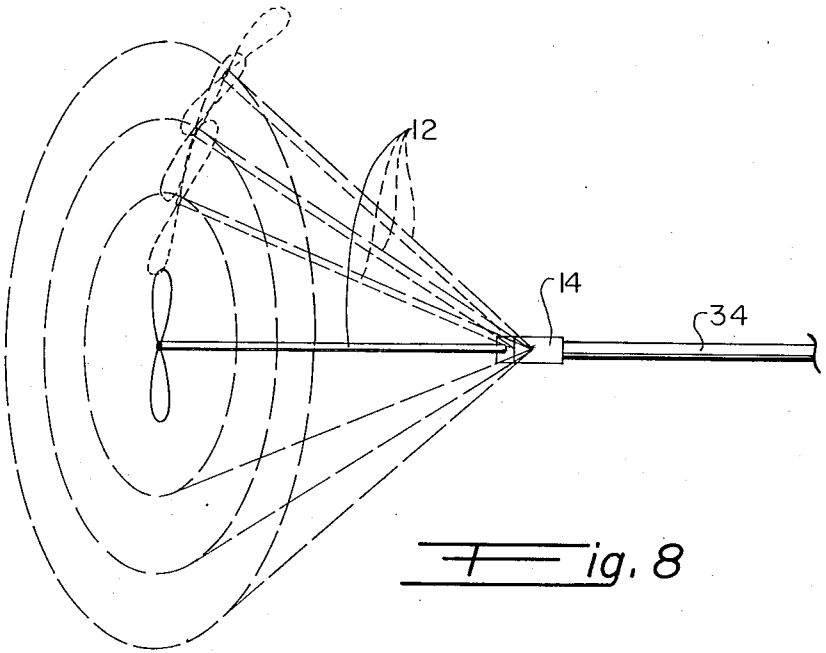
FIG. 8 shows a representative family of cones that the propeller shaft can be oriented in when steered in accordance with the invention.

FIG. 8 illustrates a representative family of cones which represent some of the orientations of the propeller shaft 12 with respect to the drive shaft 34 when the propeller shaft 12 is steered in accordance with the present invention.

Figure 9:
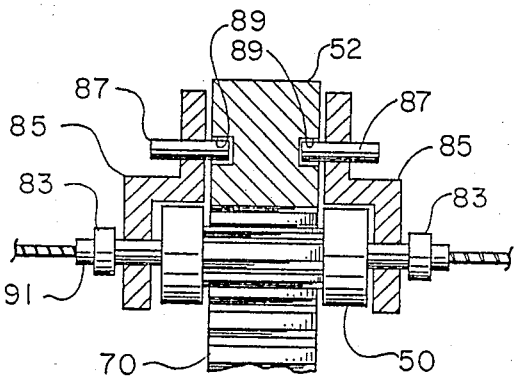
FIG. 9 shows an enlargement of the cross-section taken along line 9—9 in FIG. 1.

In FIG. 9, a close up of the first tilt gear 50 and its relationship to the inner annular gear 70 is shown in the preferred embodiment. Support brackets 85 on each side of first tilt gear 50 support gear 50 and maintain gear 50 in mesh with inner annular gear 70. Brackets 85 are supported by pins 87 which ride in grooved circular channels 89 that are formed in second tilt gear 52. First tilt gear 50 has outside threaded projections 91 which receive lock nuts 83 which secure brackets on tilt gear 50 and retain pins 87 in channels 89. When tilt gear 50 is rotated by gear 70, the pins 87 ride in circular channels 89.

Figure 10:
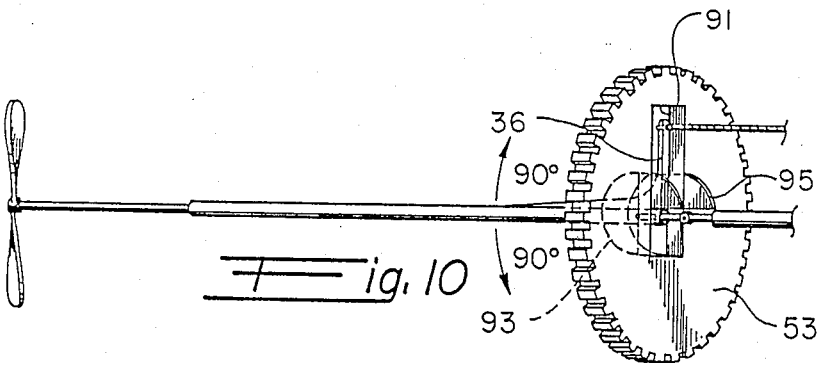
FIG. 10 shows an alternate embodiment of the invention wherein the second rotation gear has an upwardly extending rectangular slot and the angled projection means is at a 90 degree angle.

FIG. 10 shows another embodiment of the invention. In this embodiment, the second rotation gear 53 has an inner opening 91 preferably formed as an upwardly extending rectangular slot. In this embodiment of the invention, line receiving gear 56 and the flexible chain 54 are not needed. In this embodiment, the angles projection 36 has a 90 degree angle and is comprised of an upwardly extending right-angles portion 36. Right angled projection 36 is located in the rectangular slot 91.

Two benefits of the 90 degree angular projection 36 are: (a) a near hemisphere can be traced by the steering apparatus when moved to its extreme limits; and (b) to allow the propeller shaft 12 to move up and down within substantially 180 degrees.

A study of FIG. 8 reveals that the family of cones that is generated by the apparatus of the invention does not include cones that have such a large apex angle that they approximate a hemisphere. However, with the embodiment of the invention shown in FIG. 10, the apex angle of the cones that are generated approaches a 180 degree angle which approximates a hemisphere.

In the embodiment of the invention shown in FIG. 10, guide means 93 are provided to guide the propeller shaft 12 in first sleeve 32. Additional guide means 95 are provided for the right angle projection 36. Both guide means 93 and guide means 95 are unified with the second rotation gear 53.

In FIG. 1, strut guide means 64 and in FIG. 10, guide means 95 together serve to keep the following structures in alignment and prevent them from twisting: second telescoping strut means 44; threaded bar 40; and angled projection 36.

Figure 12:
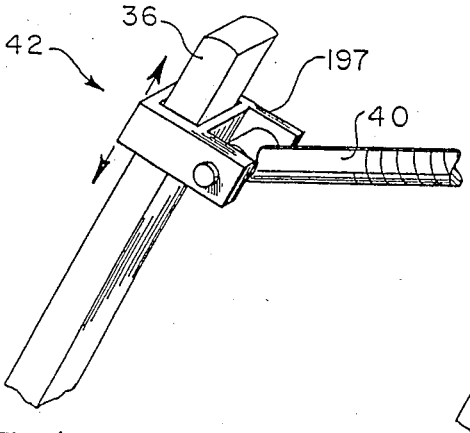
FIGS. 11 and 12 show alternate structures for the varying length strut means.
Figure 11:
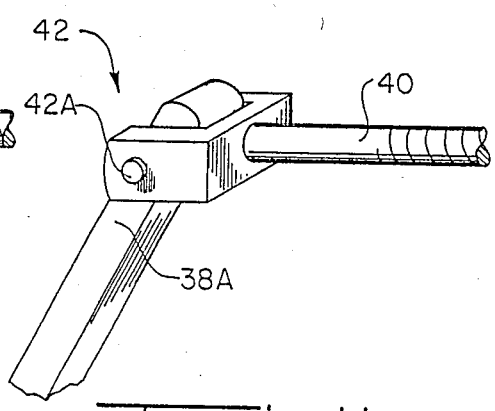

In FIGS. 11 and 12, alternate embodiments for the joint 42 between the varying length strut 38 and threaded bar 40 are shown. In FIG. 11, the varying length strut 38 is shown to be the telescoping strut 38A, and the joint 42 is shown to be an axle 42A which prevents longitudinal rotation of the joined elements around their respective longitudinal axes. Only rotation around the axle 42A is permitted.

In FIG. 12, the joint 42 is between angled projection 36 and threaded bar 40. In this embodiment, the effective length of the angled projection 36 is variable because joint 42 is comprised of a squared-cross-sectioned ring 197 attached to the bar 40. The angled projection 36 is also shown to be of square cross-section. The square ring 197 slides up and down the squared angled projection 36 thereby changing the effective length of the angled projection 36. The complementary engagement of the squared projection 36 with the squared ring 197 prevent rotation around the longitudinal axes of the joined parts.

Figure 13:
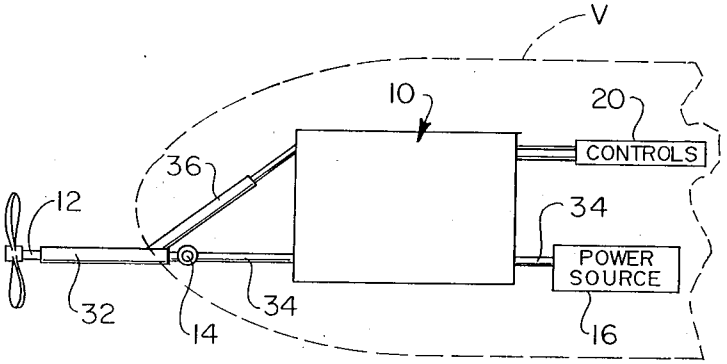
FIG. 13 shows a schematic of a submarine or amphibious vehicle having propeller shaft steering in accordance with the invention.

FIG. 13 shows an embodiment of the invention used in a submarine, torpedo, or amphibious vehicle (generally designated as at V). Propeller shaft 12 is jacketed by first sleeve 32, and a universal joint 14 connects the propeller shaft 12 with the drive shaft 34. Power source 16 provides power to the drive shaft 34. The steering apparatus of the invention 10 is controlled by controls 20.

Figure 14:
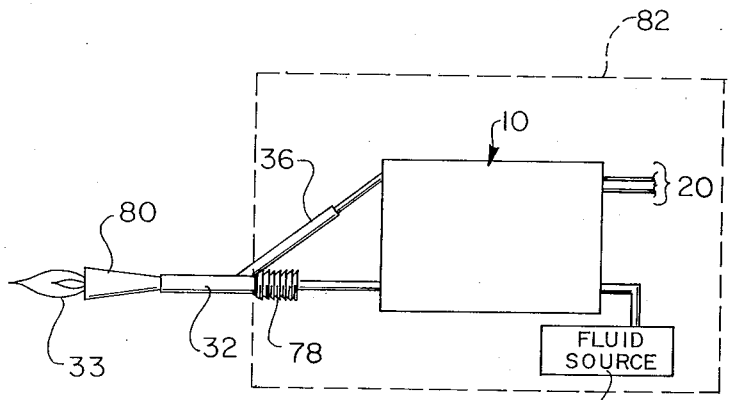
FIG. 14 shows a schematic of fluid flow steering in accordance with the invention.

FIG. 14 shows an embodiment of the invention 10 used for steering a fluid projecting embodiment. Specifically, the embodiment shown in FIG. 14 is for a rocket motor 99 in a rocket 82 whose gaseous exhaust 33 coming out of steered nozzle 80 is steered by an embodiment 10 of the invention. Another embodiment of the invention for steering a moving fluid stream can be used for steering a water stream from a fire hose. For an embodiment for steering a fire hose, the fluid source 99 would be a high pressure source of water. With a fluid steering embodiment such as gaseous exhaust from a rocket motor or high pressure water, a coupling 78 is located between the steered conduit 80 and a stationary conduit 76 connected to the fluid source 99 which provides a flowing fluid. The coupling 78 is a fluid tight and flexible coupling so that it can contain the flowing fluid being steered, and so it can be easily bent for steering purposes.

Figure 15:
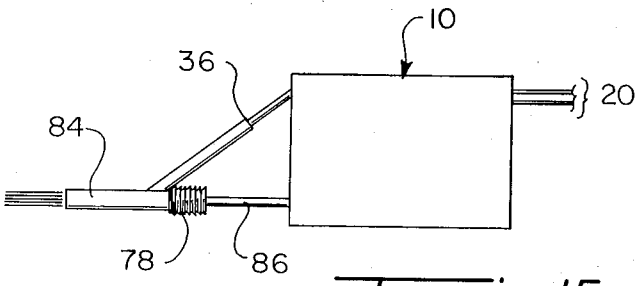
FIG. 15 shows a schematic of laser beam steering in accordance with the invention.

FIG. 15 shows an embodiment of the invention in use for steering a laser beam device 84. Support 86 is connected to coupling 78 which is connected to the steered laser beam device 84.

Figure 16:
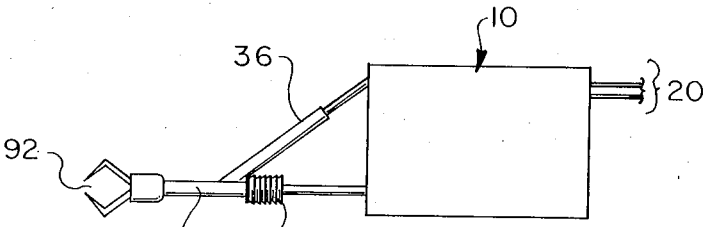
FIG. 16 shows a schematic of a robotic arm steered in accordance with the invention.

In FIG. 16, a robotic arm 90 having remote controlled arms 92 is steered by an embodiment of the invention in a manner similar to the steering of the laser beam device 84 in FIG. 15.

In the descriptions provided above, the steering apparatus of the invention is controlled by control means 20. A variety of specific control means 20 can be employed with the invention. For example, the control means 20 can be one of more joy sticks. Control means 20 can also be a combined steering wheel and movable stick such as used for steering and controlling an airplane. The control means 20 can also be computer controlled motors. Control means 20 can also be operated by remote control.

Although in FIG. 1, there is only one first tilt gear 50 and one second tilt gear 52 shown, it is contemplated that for heavy duty applications plural first tilt gears 50 and plural second tilt gears 52 can be employed.

In addition to the areas of application of the steering apparatus of the invention as described above, it is also contemplated that embodiments of the invention can be used to steer an electric fan, for the remote control handling of nuclear material, and for a tracking servo system.

The foregoing description of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of the ordinary skill in the art to best utilize the invention in various embodiments and with various modifications as are suited to the particular use contemplated. It is intended that the scope of the invention be defined by the claims appended hereto.

What is claimed is:

1. A steering apparatus for steering an article or material, said steering apparatus, comprising:

means for changing direction of the steered article or material;

means for both tilting and rotating said direction changing means;

means for tilting said means for both tilting and rotating said direction changing means; and means for rotating said means for both tilting and rotating said direction changing means, wherein said tilting means is comprised of first varying length strut means connected to an angled projecting means, threaded bar means, first joint means for connecting said threaded bar means to said first varying length strut means, second varying length strut means, second joint means for connecting said threaded bar means to said second varying length strut means, receiving sleeve means which telescopically receives said second varying length strut means, second sleeve means connected to said receiving sleeve means, internally threaded and externally toothed first tilt gear means mounted on said threaded bar means by threaded engagement, eccentric second tilt gear means engaging said first tilt gear means for rotating said first gear means along said threaded bar means and for raising and lowering said threaded bar means which raises and lowers said angled projecting means, thereby tilting said direction changing means.

2. An apparatus as described in claim 1, wherein said means for both tilting and rotating said direction changing means is comprised of first sleeve means and said angled projecting means and wherein said tilting means is further comprised of flexible line means connected to said first sleeve means, rotating line receiving means for receiving said line means, line connecting means for connecting said line means to said angled projecting means.

3. An apparatus as described in claim 2 wherein said flexible line means is comprised of a chain and said line receiving means is comprised of a toothed gear for engaging said chain.

4. An apparatus as described in claim 1 wherein said tilting means is further comprised of first control shaft and gear means for engaging said eccentric second tilt gear means.

5. An apparatus as described in claim 1, further comprising spring means for connecting said receiving sleeve means to said second sleeve means.

6. A steering apparatus for steering an article or material, said steering apparatus, comprising:

means for changing direction of the steered article or material;

means for both tilting and rotating said direction changing means;

means for tilting said means for both tilting and rotating said direction changing means; and means for rotating said means for both tilting and rotating said direction changing means, wherein said rotating means comprises first control shaft and gear means, second control shaft and gear means, and third control gear means, said second control shaft and gear means and third control gear means for rotating first rotation gear means and second rotation gear means, respectively, said second rotation gear means connected to axle means, said axle means connected to said direction changing means for rotating said direction changing means, said second rotation gear means connected to strut means for rotating a second sleeve, said second sleeve means connected to said first rotation gear means for rotating with said first rotation gear means, said first control shaft and gear means for rotating said tilting means, wherein said tilting means and said rotating means rotate together as a unit.

7. A steering apparatus for steering a propeller shaft connected to a rotating power source by a universal joint, said apparatus, comprising:

means for changing direction of the steered article or material, means for both tilting and rotating said direction changing means, wherein said means for both tilting and rotating said direction changing means is comprised of first sleeve means and an angled projecting means projecting from said first sleeve means, means for tilting said means for both tilting and rotating said direction changing means, means for rotating said means for both tilting and rotating said direction changing means wherein said rotating means is comprised of first control shaft and gear means, second control shaft and gear, means, and third control gear means, said second control shaft and gear means and third control gear means for rotating first rotation gear means and second rotation gear means, respectively, said second rotation gear means connected to axle means, said axle means connected to said direction changing means for rotating said direction changing means, said second rotation gear means connected to strut means for rotating a second sleeve, said second sleeve means connected to said first rotation gear means for rotating with said first rotation gear means, said first control shaft and gear means for rotating said tilting means, wherein said tilting means and said rotating means rotate together as a unit.

8. An apparatus as described in claim 7 further comprising spring means for connecting said angled projecting means to said second sleeve means.

9. A steering apparatus for steering a laser beam means, said steering apparatus, comprising:

steerable laser beam means, coupling means for coupling said steerable laser beam means to a support;

means for changing direction of the laser beam means;

means for both tilting and rotating said direction changing means;

means for tilting said means for both tilting and rotating said direction changing means; and means for rotating said means for both tilting and rotating said direction changing means, wherein said tilting means is comprised of first varying length strut means connected to an angled projecting means, threaded bar means, first joint means for connecting said threaded bar means to said first varying length strut means, second varying length strut means, second joint means for connecting said threaded bar means to said second varying length strut means, receiving sleeve means which telescopically receives said second varying length strut means, second sleeve means connected to said receiving sleeve means, internally threaded and externally toothed first tilt gear means mounted on said threaded bar means by threaded engagement, eccentric second tilt gear means engaging said first tilt gear means for rotating said first gear means along said threaded bar means and for raising and lowering said threaded bar means which raises and lowers said angled projecting means, thereby tilting said direction changing means thereby steering said steerable laser beam means.

10. A steering apparatus for steering a flowing fluid means, said steering apparatus, comprising:

steerable flowing fluid means, coupling means for coupling said steerable flowing fluid means to a flowing fluid source;

means for changing direction of the flowing fluid;

means for both tilting and rotating said direction changing means;

means for tilting said means for both tilting and rotating said direction changing means; and means for rotating said means for both tilting and rotating said direction changing means, wherein said tilting means is comprised of first varying length strut means connected to an angled projecting means, threaded bar means, first joint means for connecting said threaded bar means to said first varying length strut means, second varying length strut means, second joint means for connecting said threaded bar means to said second varying length strut means, receiving sleeve means which telescopically receives said second varying length strut means, second sleeve means connected to said receiving sleeve means, internally threaded and externally toothed first tilt gear means mounted on said threaded bar means by threaded engagement, eccentric second tilt gear means engaging said first tilt gear means for rotating said first gear means along said threaded bar means and for raising and lowering said threaded bar means which raises and lowers said angled projecting means, thereby tilting said direction changing means thereby steering said steerable flowing fluid means.

11. An apparatus as described in claim 10, wherein said flowing fluid is exhaust gas from a rocket motor.

12. An apparatus as described in claim 10, wherein said flowing fluid is pressurized water in a water hose.

13. A steering apparatus for steering an article or material, said steering apparatus, comprising:

steerable robotic arm means, coupling means for coupling said steerable robotic arm means to a support;

means for changing direction of the steered article or material;

means for both tilting and rotating said direction changing means;

means for tilting said means for both tilting and rotating said direction changing means; and means for rotating said means for both tilting and rotating said direction changing means, wherein said tilting means is comprised of first varying length strut means connected to an angled projecting means, threaded bar means, first joint means for connecting said threaded bar means to said first varying length strut means, second varying length strut means, second joint means for connecting said threaded bar means to said second varying length strut means, receiving sleeve means which telescopically receives said second varying length strut means, second sleeve means connected to said receiving sleeve means, internally threaded and externally toothed first tilt gear means mounted on said threaded bar means by threaded engagement, eccentric second tilt gear means engaging said first tilt gear means for rotating said first gear means along said threaded bar means and for raising and lowering said threaded bar means which raises and lowers said angled projecting means, thereby tilting said direction changing means thereby steering said steerable flowing fluid means.

* * * * *